US012336629B2

(12) United States Patent
Bobby et al.

(10) Patent No.: US 12,336,629 B2
(45) Date of Patent: Jun. 24, 2025

(54) LINEAR DRIVE AND LIFTING TABLE

(71) Applicant: Ewellix AB, Gothenburg (SE)

(72) Inventors: Guo Bobby, Shanghai (CN); Fabian Mantl, Liestal (CH); Marcel Soltermann, Liestal (CH)

(73) Assignee: Ewellix AB, Gothenburg (SE)

( * ) Notice: Subject to any disclaimer, the term of this patent is extended or adjusted under 35 U.S.C. 154(b) by 121 days.

(21) Appl. No.: 18/302,140

(22) Filed: Apr. 18, 2023

(65) Prior Publication Data

US 2023/0363527 A1 Nov. 16, 2023

(30) Foreign Application Priority Data

May 12, 2022 (DE) ..... 10 2022 111 965.3

(51) Int. Cl.
*A47B 9/16* (2006.01)

(52) U.S. Cl.
CPC ..... *A47B 9/16* (2013.01)

(58) Field of Classification Search
CPC ..... A47B 9/16
See application file for complete search history.

(56) References Cited

U.S. PATENT DOCUMENTS 3,292,421 A * 12/1966 Meyer ..... G01N 27/74 73/25.02
2020/0284329 A1* 9/2020 Soltermann ..... B66F 7/0666
2020/0400517 A1* 12/2020 Benoit ..... H02K 5/225

FOREIGN PATENT DOCUMENTS

JP 2021032891 A * 3/2021 ..... B30B 1/18

* cited by examiner

*Primary Examiner* — Matthew W Ing
(74) *Attorney, Agent, or Firm* — Laurence A. Greenberg; Werner H. Stemer; Ralph E. Locher

(57) ABSTRACT

A lifting table contains a linear drive. The linear drive has a housing, a drive with an electric motor arranged outside the housing, and a linear unit arranged in the housing. In addition, a sensor device for determining a force acting on the linear drive is provided. The sensor device has a stress body, which is configured to axially support a drive-side end of the linear unit and on the inner or outer surface of which there is arranged a load sensor assembly for detecting a mechanical stress of the stress body.

14 Claims, 2 Drawing Sheets

LINEAR DRIVE AND LIFTING TABLE

FIELD AND BACKGROUND OF THE INVENTION

The present invention relates to a linear drive and to a lifting table comprising such a linear drive.

Linear drives are known for moving machine parts or for actuating gearing mechanisms and are also referred to as electromechanical cylinders. Such linear drives usually have a linear unit, by means of which a rotation of a motor shaft can be converted into a translation of a component of the linear unit.

Many processes are dependent on the force that is exerted by a linear drive. In order to be able to make process decisions reliably in such a case, it is known to equip linear drives with load sensors. For example, the force actually applied can thus be determined, and the linear drive can be controlled on this basis. What is important here when using such a load sensor is, in particular, that the sensor is placed in such a way that a force flow through the linear drive is detectable by the sensor substantially completely. A regular challenge here, when integrating such a sensor, is keeping the installation space necessary for the sensor low so as to be able to use the linear drive also in a confined space and at the same time so as not to limit the path of movement of the components of the linear unit mounted in translation.

SUMMARY OF THE INVENTION

The object of the present invention is to improve the integration of a load sensor in a linear drive, in particular to arrange the sensor in such a way that a load measurement can be performed particularly reliably.

This object is achieved by a linear drive and a lifting table comprising such a linear drive according to the independent claims.

Preferred embodiments are the subject of the dependent claims and the following description.

A linear drive according to a first aspect of the invention has: (i) a housing; (ii) a drive with an electric motor arranged outside the housing; and (iii) a linear unit arranged in the housing and operatively connected to the drive. In addition, (iv) a sensor device for determining a force acting on the linear drive is provided. The sensor device has a stress body, expediently a hollow-cylindrical stress body, which is designed to axially support a drive-side end of the linear unit and on the inner or outer surface of which there is arranged a load sensor assembly for detecting a mechanical stress of the stress body.

A mechanical stress in the sense of the present invention preferably corresponds to one or more forces in the material of a component, for example the stress body. A mechanical stress can be brought about for example by a deformation, for example an elongation, compression, twisting and/or the like. In this regard, a detection of the stress is also a detection of the deformation.

One aspect of the invention is based on the approach of providing a linear drive with a sensor device which is arranged well protected inside a housing in which there is also disposed a linear unit. In order to make the force flow resulting from a loading of the linear drive measurable by means of the sensor device, the linear unit is preferably axially supported with the aid of a cylindrical or sleeve-like stress body, which in turn is expediently supported on the housing. As a result of this arrangement, an axial load acting for example on a thrust tube and transferred via a nut, which is fastened to the thrust tube, to a threaded spindle of the linear unit and, from there, to the stress body via a bearing assembly arranged in the stress body, can cause a mechanical stress in the stress body. This stress can be detected by a corresponding load sensor, which is arranged on an inner or outer surface of the stress body.

It is particularly advantageous here if the stress body supports the linear unit axially in the region of an end at which the linear unit is operatively connected to a drive. The load sensor is thus protected against physical influences that could lead to damage. At the same time, the installation space required by the sensor device can be kept minimal.

A linear drive according to a further aspect of the invention has: (i) a housing; (ii) a drive with an electric motor arranged outside the housing; and (iii) a linear unit arranged in the housing. In addition, a sensor device for determining a force acting on the linear drive is provided. Here, the sensor device has at least one load sensor assembly, which is arranged on a housing outer side in such a way, in the region of a housing mounting for supporting the housing on an external component, that a mechanical stress of the housing tangentially to an axis defined by the housing mounting is detectable with the aid of the load sensor assembly. Here, a tangential detection is expediently understood to mean a detection at a point where the stress runs at right angles to a connecting line, in particular the shortest connecting line, between the detection point and the axis. In other words, a tangential detection is preferably a detection at a point of intersection of a tangent with its circle which has the axis as center point.

A linear drive according to a further aspect of the invention has: (i) a housing; (ii) a drive with an electric motor arranged outside the housing; and (iii) a linear unit with a threaded spindle, mounted rotatably in the housing, and a nut, which performs a movement in translation in the housing when the threaded spindle rotates and to which there is fastened a thrust tube, in particular a hollow-cylindrical thrust tube, which can be driven out at least in part from the housing during the movement in translation. In addition, a sensor device for determining a force acting on the linear drive is provided. Here, the sensor device has at least one load sensor assembly, which is arranged on an outer surface and/or on an inner surface of the thrust tube and is designed to detect a mechanical stress of the thrust tube. For example, load sensors of the load sensor assembly can be distributed on the outer and/or inner surface.

In accordance with these further aspects, axial installation space inside the housing can be saved by linear drives. In addition, a linear drive can thus also be easily retrofitted with a sensor device.

Hereinafter, preferred embodiments of the invention and developments thereof will be described, which can each be combined arbitrarily with one another and with the aspects of the invention described further below, unless this is expressly excluded.

In a preferred embodiment, the stress body is arranged in the housing axially between at least a part of the linear unit and at least a part of the drive. For example, a nut of the linear unit, for example with the aid of a bearing assembly, can be mounted rotatably within the stress body. In this case, the stress body is expediently arranged between the nut and at least a part of the drive, for example a gearing part. With this arrangement between linear unit and drive, the entire force flow through the linear drive can be detected reliably.

In a further preferred embodiment, the drive has a gearing, for example in order to adjust a torque generated by the electric motor. The stress body is then expediently arranged axially between at least a part of the linear unit and at least a part of the gearing. The load sensor is particularly well protected there against electromagnetic fields which are generated during operation of the electric motor and which might adversely affect the operation of the sensor, for example reduce the measurement accuracy or falsify the measurement results.

In a preferred embodiment, the housing is of modular construction. The load sensor assembly is expediently housed by a bearing housing part for the bearing assembly for rotatable mounting of a threaded spindle or nut of the linear unit. The bearing housing part is preferably arranged between a linear unit housing part for the linear unit and a drive housing part for at least a part of the drive. With this arrangement the load sensor assembly advantageously does not move with the thrust tube. A cable routing or the transmission of a signal of the load sensor assembly can thus be simplified significantly. In addition, the sensor device can thus be arranged particularly easily between the linear unit and the drive—and thus protected against external influences. In addition, the stress body can be mounted particularly easily, for example by clamping between two housing parts.

Alternatively, the bearing assembly can also be arranged in the drive housing part, in particular in a part that houses the gearing. In this case, the bearing housing part can be spared. The stress body is then likewise arranged in the drive housing part, expediently together with the load sensor assembly, and preferably clamped between the linear unit housing part and the drive housing part.

In a further preferred embodiment, the stress body has a radial flange. The flange is preferably clamped axially, in particular at least in portions, between the linear unit housing part and the bearing housing part. This allows not only an axial fixing of the stress body in the housing, but also the transfer of a force flow through the stress body to the housing.

In a further preferred embodiment, the bearing housing part has at least one axial through-bore. The through-bore is expediently passed through by a fastening means, for example a screw, in order to fasten the bearing housing part to the linear unit housing part. The through-bore, moreover on the drive side, i.e. at an end closest to the gearing or furthest away from the linear unit housing part, has a larger diameter than at an opposite end. A head of the fastening means with an inner tool receptacle is recessed fully in the through-bore. The housing parts can thus be fastened to one another without the need for any external fastening means, which take up installation space.

In a further preferred embodiment, the fastening means has a circumferentially extending seal element, for example an O-ring. The seal element is preferably arranged around the head with the inner tool receptacle. The housing interior can thus be sealed for example with respect to lubricant leakage and/or external influences by fastening the bearing housing part to the linear unit housing part.

In a further preferred embodiment, the through-bore is open at least in portions to the interior of the bearing housing part in the region of the larger diameter. This allows a radially particularly compact design of the housing.

In a further preferred embodiment, the housing has a top piece, which can be formed as a housing cover. The top piece is preferably arranged on a housing outer side. Expediently, a signal processing electronics unit of the sensor device is arranged below the top piece. The signal processing electronics unit can thus be mounted well protected—and easily accessible by removal of the top piece—on the housing outer side.

A housing opening can be provided below the top piece, and a signal-conducting connection between the load sensor and the signal processing electronics unit is guided through said opening. The top piece thus expediently protects not only the signal processing electronics unit, but also the housing opening—and thus the interior of the housing—for example against contaminants.

Here, the top piece can be formed separately from or also as part of the bearing housing, in particular in one piece with the bearing housing. The number of components of the linear drive can thus be reduced and the assembly simplified.

Alternatively, the signal processing electronics unit of the sensor device is arranged in the bearing housing part or in the drive housing part, in particular in the bearing housing part. In particular, the drive housing part can have a pocket, in which the signal processing electronics unit—protected for example from the gearing—is arranged. The structure of the linear drive can thus be simplified further.

In a further preferred embodiment, the stress body, on the outer surface, has at least one recess for partly receiving a fastening means, by means of which the stress body is fastened in the housing, in particular the flange is clamped between the bearing housing part and the linear unit housing part. This allows a design of the housing that, radially, is even more compact.

In a further preferred embodiment, the sensor device is designed in such a way that safety level 2 according to IEC standard 61508 is satisfied, i.e. for example the risk of failure is at most once in 100 to 1000 years. The linear drive can thus also be used in applications in which the safety of people is concerned.

In a further preferred embodiment, the load sensor assembly comprises two, preferably four, or more load sensors. The load sensors are preferably distributed, in particular regularly, along the circumference of the stress body. Besides increased precision in the detection of the mechanical stress of the stress body, of the housing or of the thrust tube by combination of the measured values of the different load sensors, the risk of a total failure of the load sensor assembly can also be reduced significantly.

In order to simplify the construction of the linear drive, it is also conceivable to provide the load assembly with just one load sensor.

In a further preferred embodiment, every two load sensors of the load sensor assembly are arranged in mutually opposed positions on the inner or outer surface of the stress body, of the housing outer side or of the outer surface of the thrust tube. Here, every two load sensors are expediently combined to form an evaluation unit. In other words, the signals of every two load sensors are handled jointly. It is thus possible to process the sensor signals jointly, whereby it is possible to save electronic components and thus space and costs. A symmetrical arrangement and/or processing of this kind can additionally simplify the sensors significantly and/or—with at least two sensor pairs—can ensure that each sensor is provided redundantly.

In a further preferred embodiment, the load sensor assembly comprises a line clip, which engages circumferentially around the outer surface at least in part and via which at least one load sensor is connectable signal-conductingly to a signal processing electronics unit—which does not have to be part of the linear drive—preferably arranged outside the housing. The line clip preferably has a flexible printed circuit board (PCB) placed around the outer surface. A line clip of this kind allows reliable signal transmission from the sensor to the signal processing electronics unit and/or can reduce the assembly effort. In order to save space and reduce cost, however, the use of a cable or cable harness is also conceivable.

In a further preferred embodiment, the sensor device has the signal processing electronics unit arranged in particular on a housing outer side. The signal processing electronics unit expediently has at least two separate channels for signal processing. Each of the channels is preferably able to be fed with signals from at least two load sensors. Due to the corresponding redundancy, the reliability of the stress detection can be increased.

In a further preferred embodiment, a motor shaft runs radially at a distance from and parallel to the linear unit, for example to the threaded spindle or to the nut. The electric motor is preferably arranged laterally next to the housing, in particular the linear unit. As a result of this arrangement, both a thermal and also electromagnetic decoupling of the sensor device from the electric motor can be achieved reliably.

Alternatively, the motor shaft and the threaded spindle and/or nut are arranged substantially coaxially. For example, the motor and the threaded spindle or nut can be coupled via a planetary gearing. The electric motor, the gearing and the linear unit can thus be arranged "in-line", which is favourable in respect of installation space.

Alternatively, however, the electric motor can also be connected directly—i.e. without a gearing—to the threaded spindle. In this case, the use of a high-torque electric motor is expedient.

A lifting table according to a second aspect of the invention has a scissor mechanism and a linear drive according to the first one of the further aspects of the invention for actuating the scissor mechanism. The linear drive is expediently coupled to the scissor mechanism in such a way that a platform supported by the scissor mechanism is height-adjustable by the linear drive.

In a preferred embodiment, the lifting table is mobile. For this purpose, it expediently comprises a chassis provided with wheels, on which the scissor mechanism are supported.

The invention will be explained in greater detail hereinafter with reference to figures. Where appropriate, similarly acting elements are provided herein with like reference signs. The invention is not limited to the exemplary embodiments shown in the figures—nor in respect of functional features. The description above and the figure description below contain numerous features that are described in the dependent claims, sometimes in combination. These features as well as all other features disclosed above and in the following figure description, however, shall also be considered individually and combined to form useful further combinations by a person skilled in the art. In particular, all stated features are combinable individually and in any suitable combination with the linear drive according to the first aspect of the invention, the lifting table according to the second aspect of the invention and all further aspects of the invention.

DETAILED DESCRIPTION OF THE INVENTION

Figure 1:
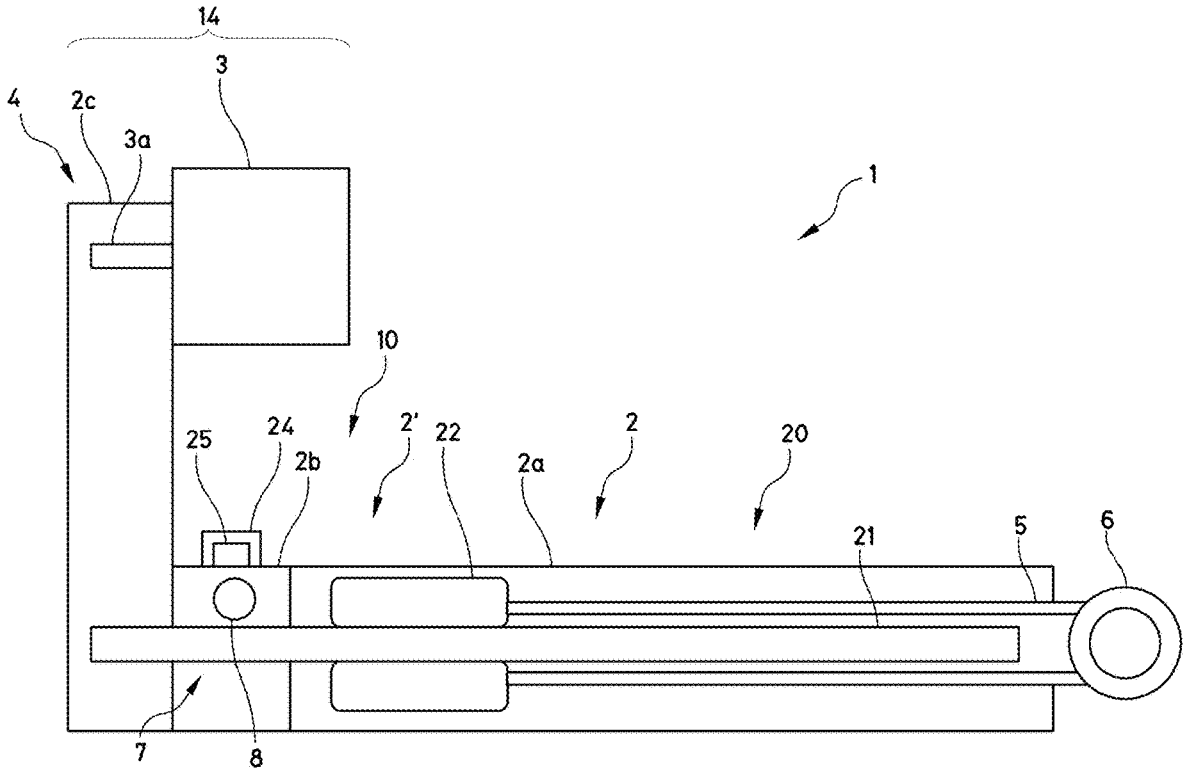
FIG. 1 an example of a linear drive with a sensor device.

FIG. 1 shows an example of a linear drive 1 with a sensor device 10 for determining a force acting on the linear drive 1. The linear drive 1 has a housing 2, an electric motor 3, and a gearing 4 for transferring a rotary movement generated by the electric motor 3 to a threaded spindle 21 of a linear unit 20, which is arranged in the housing 2. The electric motor 3 and the gearing 4 form a drive 14.

The sensor device 10, besides a load sensor assembly (see FIG. 4), can also have a signal processing electronics unit 25 for evaluating sensor signals of the load sensor assembly. The signal processing electronics unit 25 is arranged expediently for protection below a top piece 24, which is mounted on a housing outer side 2'.

A thrust tube 5 can be driven out from the housing at an end furthest away from the gearing 4. The thrust tube 5 is fastened to a nut 22, which is movable in translation by rotation of the threaded spindle 21 in the housing 2. The thrust tube carries a load-receiving means 6, here in the form of an eye, by means of which the thrust tube 5 can be fastened to a machine part or a gearing mechanism.

Alternatively, however, a so-called "screw-jack" design is also conceivable, in which the threaded spindle 21 is movable in translation by rotation of the nut 22.

In the shown example the linear drive 1 comprises a housing mounting 7 for support on a machine or a gearing part. The housing mounting 7 can have, for example, two pins 8 arranged on opposite sides of the housing 2, one of said pins being visible in FIG. 1. The pins 8 can form part of a bearing by means of which the linear drive 1 is mounted pivotably on the machine or the gearing part.

The housing 2 shown in FIG. 1 is of modular construction. The housing 2 comprises a linear unit housing part **2*a* for the linear unit, a bearing housing part 2*b* for a bearing assembly (see FIG. 2) for mounting the threaded spindle 21 in the housing 2, and a drive housing part 2*c* for a part of the drive 14, in particular the gearing 4. The sensor device 10 is preferably arranged on the bearing housing part 2*b*, particularly preferably at least in part in the bearing housing part 2*b*. This arrangement is advantageous since the force is thus measurable at a point where the force flow transitions via the bearing assembly to the housing 2**.

Alternatively to the configuration shown in FIG. 1, it is also conceivable to arrange the sensor device 10 substantially completely outside the housing 2. In particular, the load sensor assembly can also be arranged on the housing outer side 2', preferably in the region of the housing mounting 7. This is shown in conjunction with FIG. 5.

In a further variant, the load sensor assembly can also be arranged on an outer surface of the thrust tube 5. The load sensor assembly is expediently arranged here in a portion of the thrust tube 5 that also protrudes from the housing 2 when the thrust tube 5 is retracted to the maximum extent. A mechanical stress of the thrust tube 5 can be measured by a load sensor assembly arranged in this way.

By means of the external motor 3 and its spacing from the sensor device 10 on account of the gearing 4 arranged in between, the sensor device 10 can be protected against thermal and electromagnetic influences of the motor 3. It is therefore particularly advantageous if, as shown in FIG. 1, a motor shaft **3*a* of the motor 3 runs—through the gearing 4—radially at a distance from and parallel to the threaded spindle 21. Other arrangements, however, are likewise conceivable; see FIG. 5**.

Figure 2:
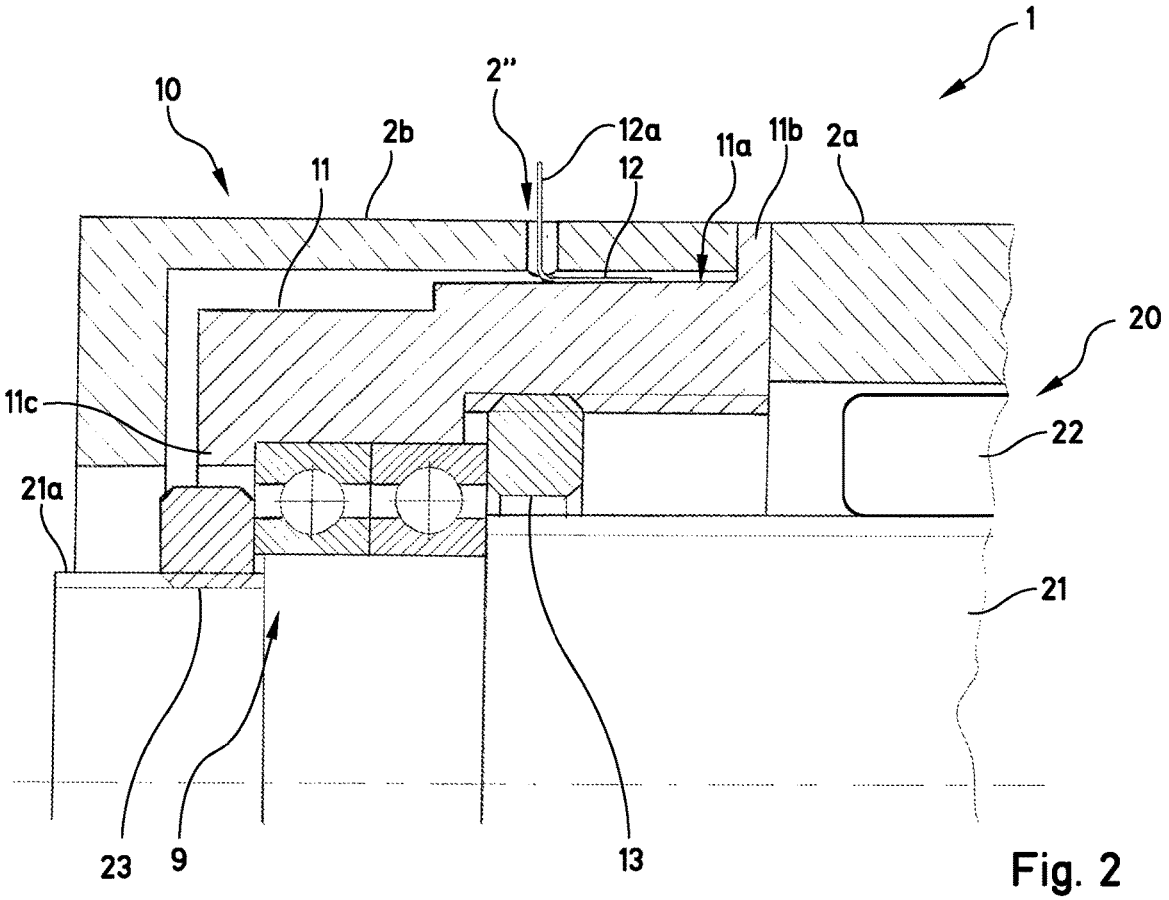
FIG. 2 an example of a sensor device arranged in a housing of a linear drive.

FIG. 2 shows an example of a sensor device 10 arranged in a housing 2 of a linear drive 1 shown only in part. The housing 2 expediently comprises a linear unit housing part 2*a* and a bearing housing part 2*b*. A linear unit 20 (only partly visible) with a threaded spindle 21 and a nut 22, which is designed for translation in the linear unit housing part 2*a* when the threaded spindle 21 is rotated, is arranged in the linear unit housing part 2*a*. The threaded spindle 21 is mounted rotatably in the bearing housing part 2*b* by a bearing assembly 9. Here, the threaded spindle 21 is expediently fixed axially to the bearing assembly 9 with the aid of a spindle securing means 23.

The spindle securing means 23 preferably fixes the threaded spindle 21 axially to the bearing assembly 9 in such a way that a proximal end 21*a* of the bearing spindle 21 protrudes axially from the bearing housing part 2*b*. At the proximal end 21*a*, the threaded spindle 21 is expediently coupled to a drive (not shown), in particular a gearing. The term "proximal" refers here to the position relative to the drive (see FIG. 1).

The sensor device 10 has a stress body 11, which is hollow-cylindrical. The stress body 10 is designed to axially support the drive-side end 15 of the linear unit 20. A sensor assembly (see FIG. 4) is arranged on an outer surface 11*a* of the stress body 11. Alternatively, however, the sensor assembly can also be arranged on the inner side of the stress body 11. The sensor assembly expediently has at least one load sensor (see FIG. 3), which is preferably electrically contacted with the aid of a line clip 12 engaging at least partially around the outer surface 11*a*. A connection part 12*a* of the line clip 12 is expediently guided out from the housing 2, in particular the bearing housing part 2*b*, through a housing opening 2". The connection part 12*a* is preferably connected to a signal processing electronics unit (not shown) arranged on the housing outer side 2'. A top piece (see FIG. 1) can house this signal processing electronics unit and at the same time the housing opening 2".

The stress body 11 expediently has a radial flange 11*b* at a distal stress body end. The flange 11*b* is preferably fixed axially between the linear unit housing part 2*a* and the bearing housing part 2*b*.

At the opposite proximal or drive-side stress body end, the stress body 11 preferably has an inner shoulder 11*c*. The shoulder 11*c* expediently supports the bearing assembly 9 axially against a thrust force pushing the proximal end 21*a* of the threaded spindle 21 out from the bearing housing part 2*b*.

On a side opposite the shoulder 11*c*, a bearing securing means 13, for example in the form of a securing nut, expediently supports the bearing assembly 9 axially against a tensile force drawing the proximal end 21*a* into the bearing housing part 2*b*. The bearing securing means 13 is preferably fixed axially in the stress body 11, for example is screwed into the stress body 11.

A force flow from the threaded spindle 21 can thus be transferred via the bearing assembly 9 to the stress body 11 and from there further via the flange 11*b* to the housing 2. The load sensor assembly is expediently arranged therefore in the region of the distal stress body end, in particular axially between the bearing securing means 13 and the flange 11*b*. Independently of the direction of the force flow, this leads specifically to a compression or stretching of the stress body in the region of the distal stress body end, i.e. axially between the bearing securing means 13 and the flange 11*b*. The mechanical stresses occurring here in the stress body 11 can be determined reliably with the aid of the load sensor assembly, in particular the at least one load sensor.

Alternatively, an assembly is also conceivable in which the nut 22 is mounted rotatably by the bearing assembly 9 and optionally fixed axially to the bearing assembly 9 by a corresponding securing means. In this case, the threaded spindle 21 is axially movable by rotation of the nut 22. The above explanations apply similarly.

Figure 3:
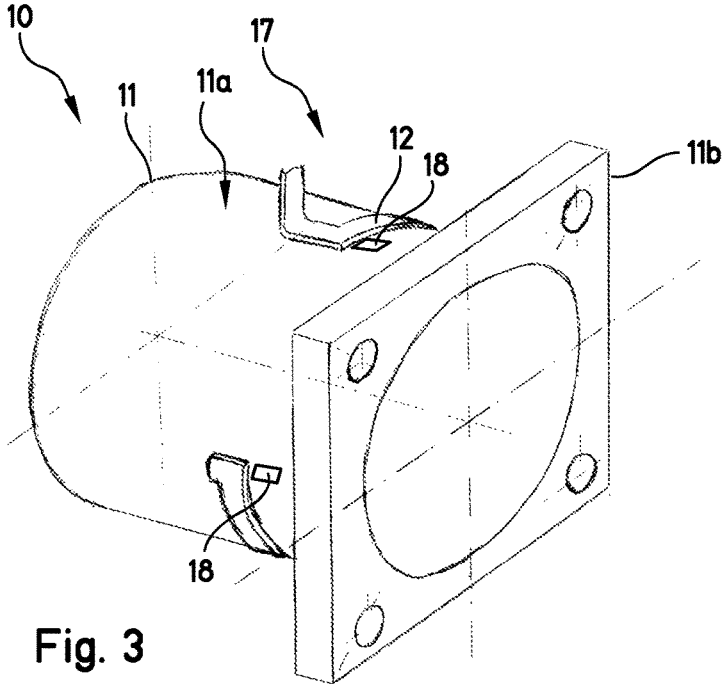
FIG. 3 a stress body in a three-dimensional illustration.

FIG. 3 shows an example of a stress body 11 of a sensor device 10 in a three-dimensional view. Here, the viewer faces a distal stress body end at which there is provided a radial flange 11*b* for fastening the stress body 11 to a housing of a linear drive (see FIG. 2).

An outer surface 11*a* of the stress body 11 is engaged around over at least part of its circumference by a line clip 12. The line clip 12 is expediently designed as a flexible printed circuit board (PCB). With the aid of the line clip 12, a plurality of load sensors 18 (in the example, four) of a load sensor assembly 17 are electrically contacted, so that electrical signals generated by the load sensors 18 can be picked up. Only two of the load sensors 18 are visible on account of the illustration selected in FIG. 3. The use of multiple load sensors 18 allows a particularly precise measurement of the mechanical stresses in the stress body 11.

The sensor device 10 formed in such a way preferably satisfies safety level 2 according to IEC standard 61508. To this end, the load sensors 18 can work redundantly, for example in pairs, for example by every two of the load sensors 18 being arranged at two opposite positions of the outer surface 11*a* and being connected correspondingly to the signal processing electronics unit. The signal processing electronics unit expediently has at least two separate channels here for signal processing. For example, the signal processing electronics unit can then process the signals from two load sensors 18 working in a pair per channel.

Figure 4:
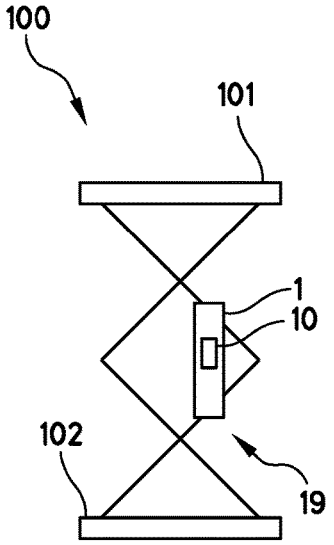
FIG. 4 an example of a lifting table.

FIG. 4 shows an example of a lifting table 100 with a linear drive 1 and a gearing mechanism in the form of a scissor mechanism 19, which can be actuated with the aid of the linear drive 1. By actuation of the scissor mechanism 19, a platform can be raised or lowered relative to a base 102. Here, a sensor device 10 makes it possible to monitor the load state of the linear drive 1. For example, overloads can be determined in good time, before a person located on the platform 101 is injured.

Figure 5:
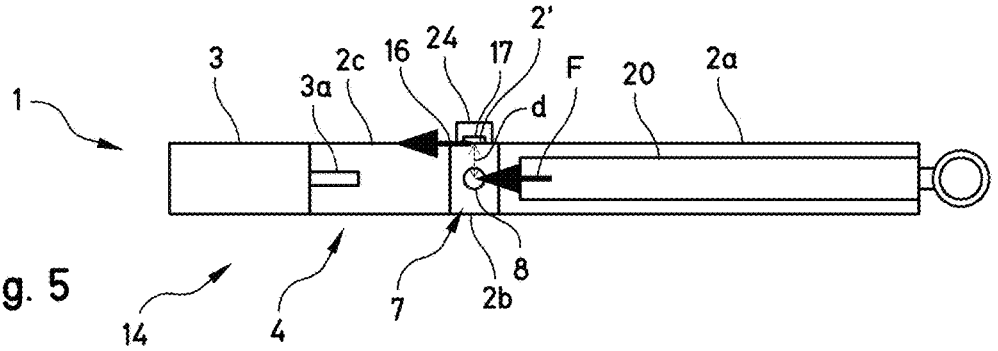
FIG. 5 an example of a linear drive with a load sensor assembly which is arranged outside a housing of the linear drive.

FIG. 5 shows an example of a linear drive 1 with a load sensor assembly 17 which is arranged outside a housing 2 of the linear drive 1. The load sensor assembly 17 is in particular arranged in such a way that a mechanical stress 16 of the housing 2 is detectable in the region of a housing mounting 7.

The housing 2 has a linear unit housing part 2*a* for a linear unit 20, a bearing housing part 2*b* for a bearing assembly for rotatably mounting a threaded spindle or nut of the linear unit 20, and a drive housing part 2*c* for at least a part of a drive 14, in particular a gearing 4 and/or an electric motor 3. The electric motor 3, gearing 4 and linear unit 20 are arranged here "in-line". Here, a motor shaft 3*a* and the linear unit 20, in particular threaded spindle or nut, expediently run coaxially. By means of the bearing assembly in the bearing housing part 2*b*, a force F acting on the linear unit 20 can be transferred to the housing 2, which, on account of the mounting 7, leads to a deformation of the housing 2 and consequently to a mechanical stress 16 in the housing 2. The load sensor assembly 17 is preferably arranged in such a way that this stress 16 of the housing 2 is detectable tangentially to an axis defined by the housing mounting 7. In other words, the load sensor assembly 17 is arranged at the point on the housing outer side 2' where the distance d between the axis and the load sensor assembly 17 is minimal, so that the stress 16 runs at right angles to a connecting line between the axis and the load sensor assembly 17. In the shown example, the axis is formed by pins 8.

LIST OF REFERENCE SIGNS

1 linear drive
2 housing
2' housing outer side
2" housing opening
2*a* linear unit housing part
2*b* bearing housing part
2*c* gearing housing part
3 motor
3*a* motor shaft
4 gearing
5 thrust tube
6 load-receiving means
7 housing mounting
8 pin
9 bearing assembly
10 sensor device
11 stress body
11*a* outer surface
11*b* flange
11*c* shoulder
11*d* recess
12 line clip
12*a* connection part
13 bearing securing means
14 drive
15 drive-side end
16 mechanical stress
17 load sensor assembly
18 load sensor
19 scissor mechanism
20 linear unit
21 threaded spindle
21*a* proximal end
22 nut
23 spindle securing means
24 top piece
25 signal processing electronics unit
100 lifting table
101 platform
102 base
F force
d distance

The invention claimed is:

1. A linear drive, comprising:
a housing;
a drive with an electric motor disposed outside said housing;
a linear unit disposed in said housing and operatively connected to said drive, said linear unit having a drive-side end;
a load sensor assembly; and
a sensor for determining a force acting on the linear drive and having a hollow-cylindrical stress body, said hollow-cylindrical stress body configured to axially support said drive-side end of said linear unit, and on an inner surface or an outer surface of said hollow-cylindrical stress body there is disposed said load sensor assembly for detecting a mechanical stress of said hollow-cylindrical stress body.

2. The linear drive according to claim 1, wherein said hollow-cylindrical stress body is disposed axially in said housing between at least a part of said linear unit and at least a part of said drive.

3. The linear drive according to claim 1, wherein said drive has a gearing and said hollow-cylindrical stress body is disposed axially between at least a part of said linear unit and at least a part of said gearing.

4. The linear drive according to claim 1,
further comprising a bearing assembly;
wherein said linear unit has a threaded spindle and a nut; and
wherein said housing is of modular construction and has a bearing housing part, a drive housing part and a linear unit housing part, said load sensor assembly is housed by said bearing housing part for said bearing assembly for rotatable mounting of said threaded spindle or said nut of said linear unit, said bearing housing part is disposed between said linear unit housing part for said linear unit and said drive housing part for at least a part of said drive.

5. The linear drive according to claim 4, wherein said hollow-cylindrical stress body has a radial flange which is clamped axially between said linear unit housing part and said bearing housing part.

6. The linear drive according to claim 1, wherein:
said sensor has signal processing electronics; and
said housing has a top piece, below said top piece said signal processing electronics is disposed.

7. The linear drive according to claim 1, wherein:
said housing has a bearing housing part and a drive housing part; and
said sensor has signal processing electronics disposed in said bearing housing part or in said drive housing part.

8. The linear drive according to claim 1, wherein said sensor is configured in such a way that safety level 2 according to international electrotechnical commission standard 61508 is satisfied.

9. The linear drive according to claim 1, wherein said load sensor assembly has at least two load sensors.

10. The linear drive according to claim 9, wherein every two said load sensors of said load sensor assembly are disposed in mutually opposite positions on an inner or outer surface of said hollow-cylindrical stress body.

11. The linear drive according to claim 9, wherein:
said sensor has signal processing electronics; and
said load sensor assembly includes a line clip, which engages circumferentially around an outer surface of said hollow-cylindrical stress body at least in part, and via said line clip at least one of said load sensors is connectable signal-conductingly to said signal processing electronics disposed outside said housing.

12. The linear drive according to claim 9, wherein said sensor has signal processing electronics with at least two separate channels for signal processing and each of said channels is able to be fed with signals from at least two said load sensors.

13. The linear drive according to claim 1, wherein said electric motor has a motor shaft which runs radially at a distance from and parallel to said linear unit.

14. A lifting table, comprising:
a scissor mechanism; and a linear drive according to claim 1 for actuating said scissor mechanism.

* * * * *